US005337915A

United States Patent [19]

Hall, Jr.

[11] Patent Number: 5,337,915

[45] Date of Patent: Aug. 16, 1994

[54] APPARATUS FOR STORING AND PRESERVING FOOD PRODUCTS AND FOR SELECTIVELY DISPENSING THE FOOD PRODUCTS FROM THE APPARATUS

[76] Inventor: Charles E. Hall, Jr., 709 Utz La., Hazelwood, Mo. 63042

[21] Appl. No.: 779,025

[22] Filed: Oct. 18, 1991

[51] Int. Cl.[5] ..... B65D 90/04

[52] U.S. Cl. ..... 220/404; 206/804; 221/226

[58] Field of Search ..... 222/392, 405; 220/403, 220/404, 93; 221/279, 226, 56; 383/33; 206/804

[56] References Cited

U.S. PATENT DOCUMENTS

| | | | |
|---|---|---|---|
| 886,243 | 9/1907 | Waechter . | |
| 1,483,196 | 2/1924 | Prince | 206/804 |
| 1,586,248 | 5/1926 | Komura | 206/804 |
| 2,047,090 | 7/1936 | Woolfson | 206/804 |
| 3,156,279 | 11/1964 | Grebowiec et al. | 220/404 |
| 3,355,080 | 11/1967 | Rausing et al. | 220/404 |
| 3,392,825 | 7/1968 | Gale et al. | 220/404 |
| 3,439,827 | 4/1969 | Marland | 206/804 |
| 3,822,806 | 7/1974 | Grimes | 215/11.3 |
| 4,266,668 | 5/1981 | Paek | 220/404 |
| 4,267,928 | 5/1981 | Curry, Jr. | 220/403 |
| 4,294,379 | 10/1981 | Bard | 220/404 |
| 4,483,440 | 11/1984 | Ware | 220/404 |
| 4,611,350 | 9/1986 | Kaczerwaski | 383/7 |
| 4,747,701 | 5/1988 | Perkins | 220/404 |
| 4,856,675 | 8/1989 | Palazzola | 220/404 |
| 4,905,869 | 3/1990 | Grigsby et al. | 221/279 |

*Primary Examiner*—Allan N. Shoap
*Assistant Examiner*—Christopher McDonald
*Attorney, Agent, or Firm*—Rogers, Howell & Haferkamp

[57] ABSTRACT

The present invention provides an apparatus for storing and preserving food products and for selectively dispensing the food products from the apparatus, wherein the apparatus comprises a container, a flexible bag inserted into and suspended in the interior of the container, and a cover member releasably securable over a top opening of the container. The bag is provided with a sidewall dimensioned to slide vertically through the interior of the container without the sidewall exerting a friction force against the inner surfaces of the container sidewalls with the bag filled with a food product. The bag is constructed of a flexible material that enables a top portion of the bag sidewall to be stretched and folded back over the top opening of the container and the outer surfaces of the container sidewalls to suspend the food product contained in the bag inside the container interior and above the container bottom wall. By selectively sliding the folded over portion of the bag vertically downward and upward over the exterior surface of the container sidewalls, the food product contained inside the bag and suspended in the container interior is raised up in the container to the top opening of the container and is lowered in the container toward the bottom wall of the container.

19 Claims, 1 Drawing Sheet

APPARATUS FOR STORING AND PRESERVING FOOD PRODUCTS AND FOR SELECTIVELY DISPENSING THE FOOD PRODUCTS FROM THE APPARATUS

BACKGROUND OF THE INVENTION

1. Field of the Invention

The present invention relates to a sealable container apparatus for food products. In particular, the present invention relates to a vertical upright container apparatus for storing and preserving food products, the apparatus comprising an upright container and a flexible bag suspended therein where the bag is vertically adjustable inside the container interior to selectively dispense food products from the top of the food container apparatus.

2. Description of the Related Art

Many different types of sealable containers for containing and preserving food products such as breads, cereals, pastries, etc. are known in the prior art. A common disadvantage found in many of these containers is that they are not designed to make the most efficient use of counter space or shelf space. These prior art containers are typically designed with their horizontal dimensions being larger than their vertical dimension, and thereby fail to make the most efficient use of the vertical space available on counter tops and on cabinet or appliance shelves for storing food products.

What is needed to make a more efficient use of available vertical space is a sealable container that stands upright on a counter top or cabinet or appliance shelf, where the vertical dimension of the container is much larger than the horizontal dimensions of the container, thereby making more efficient use of available vertical space above the counter top or cabinet or appliance shelf. However, such a container would be disadvantaged in that it would be difficult to reach down inside the container from its top opening to remove food products near the bottom of the container interior. The increased vertical dimension of the container would require the inconvenience of reaching far down inside the container interior to remove food products remaining near the bottom of the container. What is needed to overcome this disadvantage is a container apparatus having a vertically upright configuration making efficient use of storage space available above counter tops and above shelves of cabinets and appliances, where the container apparatus is provided with a mechanism for selectively raising food products contained in the apparatus to the top opening of the container apparatus and dispensing the food products from the top opening, thereby eliminating the inconvenience of reaching down into the upright container apparatus to remove food products remaining at the bottom of the apparatus.

SUMMARY OF THE INVENTION

The present invention overcomes the disadvantages associated with prior art sealable containers discussed above by providing a container apparatus for storing and preserving food products that also selectively raises the food products contained by the apparatus up to a top opening and selectively dispenses the food products from the top opening of the apparatus. The container apparatus of the present invention is comprised of only three component parts that are inexpensively manufactured and are easily assembled and operated to cause the apparatus to selectively dispense food products contained by the apparatus from the apparatus top opening.

The apparatus of the invention is basically comprised of an upright container, a flexible bag received in the container, and a cover member that is releasably sealable over a top opening of the container.

In the preferred embodiment of the invention, the container of the apparatus is comprised of a substantially square bottom wall and four sidewalls that extend upward from and are substantially perpendicular to the bottom wall. The four sidewalls and the bottom wall of the container are arranged in a general rectangular configuration and together enclose an interior volume of the container that is accessible through an opening at the top of the container. The vertical dimensions of the sidewalls are significantly larger than the horizontal dimensions of the bottom wall, thereby providing the container with a substantial amount of vertical storage space in its interior with the container occupying a relatively small area of counter space or shelf space. The container is preferably molded from plastic and is airtight. However, other materials and methods of construction may be employed in constructing the container.

The flexible bag of the apparatus is comprised of a bottom and at least one sidewall connected to and extending upward from the bag bottom. The bag bottom and sidewall are constructed of a resilient, stretchable, airtight material, preferably plastic. However, other types of resilient, stretchable, airtight materials may be employed in constructing the flexible bag. The bag preferably has a rectangular configuration to complement the rectangular configuration of the container. However, the bag may be constructed having a configuration different to that of the container, for example having a cylindrical configuration. The sidewall of the bag has a vertical dimension that is slightly larger than the vertical dimension of the container sidewalls, and in a first embodiment of the invention, the cross-section or horizontal circumference of the bag is slightly smaller than the cross-section or horizontal circumference of the container. The horizontal circumference of the bag is substantially constant along its entire vertical length between the bottom of the bag and a top opening of the bag. This enables the bag, when filled with a food product, to be easily inserted into and slid downward and upward through the interior of the container without the sidewall of the bag engaging and exerting a friction force against the interior of the container sidewalls. This dimensioning of the bag enables the bag filled with food products to be slipped vertically down through the interior of the container toward the container bottom wall, or slipped vertically upward through the interior of the container away from the container bottom wall.

In a second embodiment designed to contain and dispense a loaf of bread, the bag is dimensioned to contain a loaf of sliced bread in a vertically upright orientation. In this embodiment the horizontal circumference of the container interior is slightly larger than the horizontal circumference of the loaf of bread the apparatus is designed to contain. This dimensioning enables the bag, containing the loaf of bread, to be easily inserted into and slid upward and downward through the container interior without the bag sidewall exerting a friction force on the container sidewalls.

The ability of the bag in both embodiments of the invention to be resiliently stretched enables a top portion of the bag adjacent its top opening to be stretched out over the top edge of the container and pulled vertically downward over the exterior surface of the container. With the bag bottom suspended inside the container interior above the container bottom wall, and with a top portion of the bag sidewall stretched and folded back over the container opening and around the exterior surface of the container, the bottom of the bag may be selectively positioned in a vertically adjusted position relative to the container bottom wall. The bottom of the bag is adjustably positioned in the container interior by sliding the folded over portion of the bag sidewall downward over the exterior surface of the container to raise the bag bottom in the container interior relative to the container bottom wall, and by sliding the folded over portion of the bag sidewall vertically upward over the exterior surface of the container to lower the bag bottom in the container interior relative to the container bottom wall. In this manner, food product contained in the bag may be raised to the top of the container and dispensed from the container top opening, or may be lowered down into the container interior below the container top opening. The friction engagement of the stretched and folded over portion of the bag sidewall with the outer surface of the container sidewall suspends the bag bottom and the food product contained in the bag in a variety of vertically adjusted positions in the container interior. In the first embodiment, the dimensioning of the horizontal circumference of the bag sidewall to be slightly smaller than the horizontal circumference of the container sidewalls provides a spacing between the bag and container sidewalls. In the second embodiment specifically designed to store and dispense a loaf of bread, the dimensioning of the inner surface of the container sidewalls with a horizontal circumference larger than the horizontal circumference of a loaf of bread suspended by the bag in the container interior provides a spacing between the container sidewalls and the bread suspended in the bag. In both embodiments, the spacing enables the bag to move vertically upward and downward in the container interior while filled with a food product, while preventing the bag sidewall from engaging in friction contact with the inner surface of the container sidewalls and resisting the sliding vertical movement of the bag in the container interior.

The top cover member of the apparatus is configured to engage in a snap fit, sealed engagement over the top edge of the container and completely enclose the container interior. The cover member is dimensioned to permit the sealing engagement of the cover member over the container top opening with or without the sidewall of the bag being folded back over the top edge of the container opening. The cover member is preferably molded from plastic. However, like the container, the cover member may be constructed of other materials and by other methods.

BRIEF DESCRIPTION OF THE DRAWINGS

Further objects and features of the present invention are revealed in the following detailed description of the preferred embodiments of the invention and the drawing figures wherein.

DESCRIPTION OF THE PREFERRED EMBODIMENT

Figure 1:
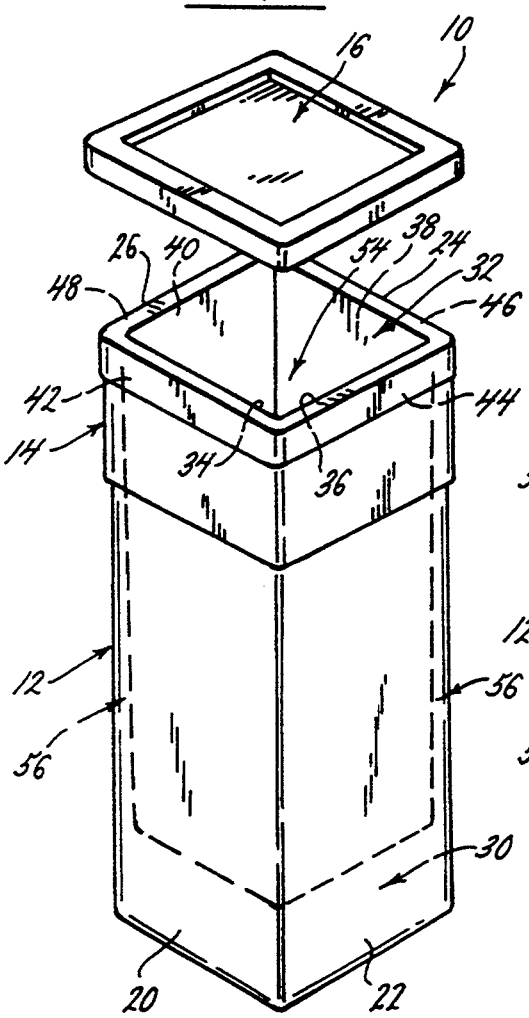
FIG. 1 is a perspective view of the container apparatus of the present invention.

The apparatus 10 of the present invention is shown in FIG. 1 of the drawing figures. As seen in FIG. 1, the apparatus 10 is basically comprised of a vertical upright container 12, a flexible bag 14 adjustably suspended in the container, and a sealing cover member 16 releasably securable over a top opening of the container and the bag. The three component parts of the invention set forth above are preferably constructed of molded plastic. However, other types of materials and other methods of construction may be employed in constructing the apparatus of the invention. The three component parts of the invention are inexpensively manufactured and are easily assembled and operated to cause the apparatus to selectively dispense food products from the top opening of the apparatus in the preferred form of the invention. However, the apparatus of the invention may be employed in storing and dispensing items other than food products. In the description of the preferred embodiment of the invention to follow, the apparatus of the invention is described as storing and dispensing food products, specifically, a loaf of bread. The use of the invention in storing and dispensing the loaf of bread is illustrative only and should not be interpreted as limiting.

In the preferred embodiment of the invention, the container 12 of the apparatus is comprised of a substantially square bottom wall 18 and four sidewalls 20, 22, 24, 26. The four sidewalls are formed integrally with the bottom wall and extend upward from and are substantially perpendicular to the bottom wall. As seen in FIG. 1, the vertical dimensions of the sidewalls 20–26 are significantly larger than the horizontal dimensions of the bottom wall 18. This provides the container 12 with a substantial amount of vertical storage space in the interior of the container compared to the relatively small counter space or shelf space the bottom wall of the container would occupy. In the preferred embodiment of the invention, the dimensions of the bottom wall 18 and the four sidewalls 20–26 are chosen to enable the insertion of a loaf of bread 28 into the container interior 30 through a top opening 32 of the container with ample room provided in the container interior to space the inner surfaces 34, 36, 38, 40 of the four sidewalls 20, 22, 24, 26, respectively, from the exterior surface of the loaf of bread. The top opening 32 of the container is bounded by four top edges 42, 44, 46, 48 of the four container sidewalls 20–26, respectively. In the preferred embodiment of the invention shown, the four sidewalls 20–26 and the bottom wall 18 of the container are arranged in a general rectangular configuration with a substantially square cross section chosen to accommodate the typical configuration of a loaf of bread.

In other applications of the invention it may be desirable to form the container with the sidewalls and bottom wall having a configuration other than that shown. For example, if the apparatus is employed in storing and dispensing a stack of bagels or cookies, the container of the apparatus would have the general configuration of a cylinder. The cylindrical container would have a circular cross section dimensioned to accommodate the stack of bagels or cookies inserted into the interior of the container with the inner surface of the container sidewall being spaced from the bagels or cookies in the same manner as that shown in FIGS. 2 and 3 with regard to the loaf of bread.

As stated earlier, the container is preferably molded from plastic and is airtight. However, other materials and methods of construction may be employed in constructing the container 12. Because the flexible bag 14 of the apparatus is itself airtight, as will be explained, it is not necessary that the container be airtight for all applications of the invention.

The flexible bag 14 of the apparatus is comprised of a bottom 50 and a sidewall 52 that is formed integrally with the bottom and extends completely around the bottom. The vertical dimension of the bag sidewall 52 is slightly larger than the vertical dimensions of the container sidewalls 20–26 as can be seen in the drawing figures. The bag bottom 50 and bag sidewall 52 are constructed of a resilient, stretchable, airtight material, preferably plastic. However, other types of resilient, stretchable, and airtight materials may be employed in constructing the flexible bag. Because the bag material is flexible, the bag conforms to the general configuration of the food product contained in the bag. In the illustrative example in the drawing figures, the general configuration of the bag 14 is rectangular, conforming to the general configuration of the loaf of bread 28. It is an important feature of the present invention that the bag sidewall 52 does not engage in friction contact with the inner surfaces 34–40 of the container sidewalls 20–26. In the example of the invention shown in the drawing figures, the bag 14 is configured to contain the loaf of bread 28 in the bag interior 54, and the cross section circumference of the container interior 30 is constant along its vertical length and is chosen to space the container sidewall inner surfaces 34–40 from the exterior surface of the loaf of bread 28 and the bag sidewall 52 surrounding the loaf of bread. It is not necessary that the bag's horizontal circumference be dimensioned smaller than the horizontal circumference of the container in this particular application of the invention because the loaf of bread 28 inserted in the bag will not exert any horizontal forces on the bag sidewall 52 causing the bag sidewall to engage in friction contact with the inner surfaces 34–40 of the container sidewalls.

In alternate embodiments of the invention, if the apparatus of the invention is to be employed in storing and dispensing food products that cause the horizontal circumference of the bag sidewall 52 to assume a circular configuration, for example, if the bag is filled with coffee, cereals, nuts or some other similar small food product, then the horizontal circumference for the entire vertical length of the bag must be dimensioned so that it will be spaced from the interior surfaces 34–40 of the container sidewalls when inserted in the container interior. This will ensure that the bag sidewall 52 will not exert any friction force on the interior surfaces 34–40 of the container sidewalls that would restrict the upward and downward vertical movement of the bag through the container interior. In such applications it is necessary that the cross section diameter of the bag be slightly smaller than the smallest distance between mutually opposed container sidewalls. This will enable the bag, when filled with a food product, to be easily inserted into and slide vertically downward and upward through the interior of the container without the sidewalls of the bag engaging and exerting a frictional force against the interior of the container sidewalls.

In all embodiments of the invention, the ability of the flexible bag 14 to be resiliently stretched enables a top portion 52′ of the bag sidewall adjacent to a top opening of the bag to be stretched out and folded back over the top edges 42–48 of the container 12 and pulled vertically downward over the container exterior surface as shown in the drawing figures. The resilience of the portion of the bag sidewall 52′ stretched over the exterior surface of the container 12 creates a friction engagement between the bag sidewall portion 52′ and the exterior surface of the container 12. The friction engagement of the bag and container is sufficient to suspend the remainder of the flexible bag 14 and the food product 28 it contains inside the container interior 30 above the container bottom wall 18.

Figure 2:
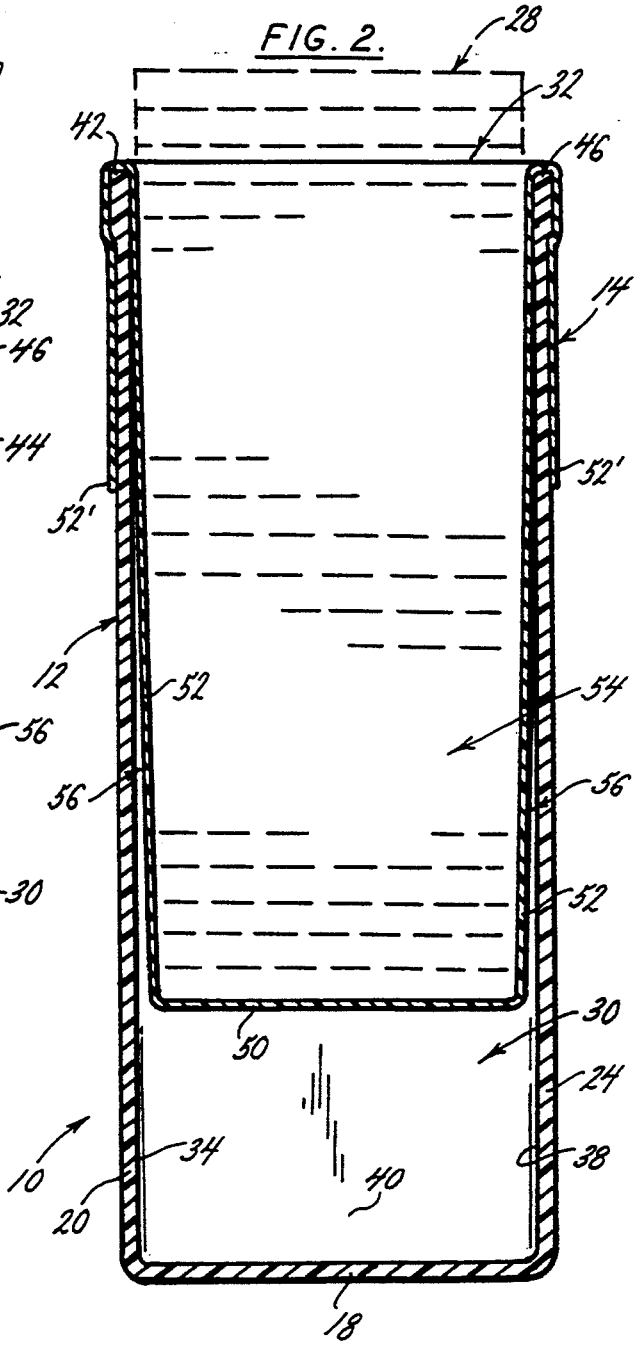
FIG. 2 is a side elevation view, in section, of the container and flexible bag of the apparatus with the cover member of the apparatus removed.
Figure 3:
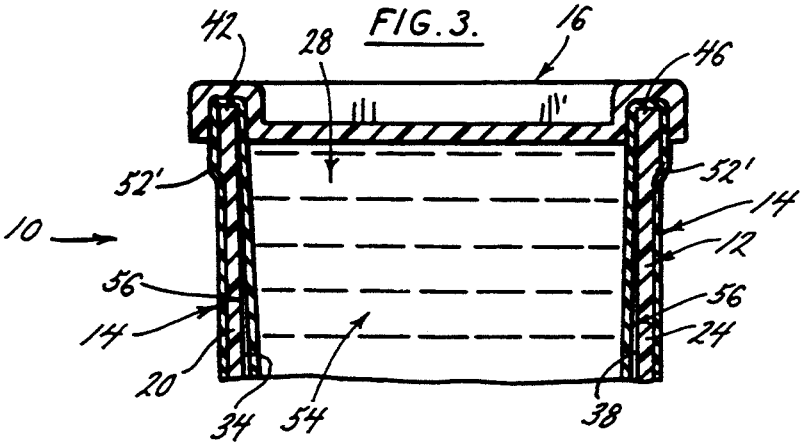
FIG. 3 is a partial elevation view, in section, showing the cover member of the apparatus engaged in sealing engagement over the top opening of the container and the sidewall of the flexible bag of the apparatus.

With the bag bottom 50 and the food product 28 contained in the bag suspended inside the container interior 30 above the container bottom wall 18, the bag bottom and food product may be selectively positioned in a vertically adjusted position relative to the container bottom wall by sliding the portion of the bag sidewall 52′ folded back over the exterior surface of the container 12 in opposite vertical directions over the container exterior surface. By sliding the folded over portion of the bag sidewall 52′ downward over the exterior surface of the container 12 the bag bottom 50 and the food product 28 contained in the bag will rise in the container interior relative to the container bottom wall 18 and food product contained in the bag will be dispensed above the top edges 42–48 of the container as shown in FIG. 2. By sliding the folded over portion of the bag sidewall 52′ vertically upward over the exterior surface of the container 12, the bag bottom 50 and the food product 28 contained in the bag will lower in the container interior relative to the container bottom wall 12. In this manner, the food product contained in the bag may be raised to the top of the container and dispensed from the container top opening, or may be lowered down into the container interior below the container top opening. The friction engagement of the stretched and folded over portion of the bag sidewall 52′ against the outer surface of the container sidewalls 20–26 is sufficient to suspend the bag bottom and the food product contained in the bag in a variety of vertically adjusted positions above the container bottom wall in the container interior.

In the first embodiment, with the bag 14 dimensioned to contain a loaf of bread 28 and the horizontal circumference of the container sidewall inner surfaces 34–40 having a measure slightly larger than the horizontal circumference of the loaf of bread 28, a spacing 56 is provided between the sidewall inner surfaces 34–40 and the bread contained in the bag 14. In the second embodiment, the dimensioning of the horizontal circumference or cross section diameter of the bag sidewall 52 slightly smaller than the horizontal circumference or minimum cross section dimension of the container sidewall inner surfaces 34–40 also provides a spacing 56 between the bag and container sidewalls. In both embodiments, the spacing 56 enables the bag 14 to move vertically upward and downward in the container interior 30 while filled with a food product while preventing the bag sidewall 52 from engaging in friction contact with the inner surfaces 34–40 of the container sidewalls and resisting the sliding vertical movement of the bag in the container interior.

The cover member 16 of the apparatus is configured to engage in a snap fit, sealed engagement over the top edges 42–48 of the container and completely enclose the container interior 30. The cover member 16 is dimensioned to permit the sealing engagement of the cover member over the container top opening with or without the side wall 52 of the bag 14 being folded back over the top edge of the container. The cover member is also preferably molded from plastic. However, like the container, the cover member may be constructed from other materials and by other methods.

Many commercially available loaves of bread are packaged in a resilient, stretchable plastic bag. In employing the apparatus of the invention in storing and preserving such a loaf of bread, it may be possible to substitute the bag used as packaging for the bread for the flexible bag 14 of the invention with the bread packaging bag functioning as a component part of the invention apparatus in the same manner as the flexible bag 14.

While the present invention has been described by reference to a specific embodiment, it should be understood that modifications and variations of the invention may be constructed without departing from the scope of the invention defined in the following claims.

What is claimed is:

1. An apparatus for storing and preserving food products and for selectively dispensing the food products from the apparatus, the apparatus comprising:

a container having a bottom wall and at least one sidewall connected to the bottom wall and extending substantially perpendicularly from the bottom wall, the sidewall having an inner surface extending around an interior of the container and the sidewall having an outer surface extending around an exterior of the container, and the sidewall having a top edge extending around an opening of the container, the opening providing access to the container interior;

a flexible bag suspended in the container interior, the bag having at least one sidewall surrounding an interior of the bag and a bottom connected to the bag sidewall, the bag sidewall having a top edge extending around an opening of the bag, the bag opening providing access to the bag interior, the bag sidewall top edge being stretched over the container sidewall top edge and around the container outer surface to suspend the bag bottom in the container interior; and the container sidewall inner surface having a circumference of a first measure and the bag sidewall having a circumference of a second measure, the second measure being less than the first measure thereby enabling the bag sidewall to be spaced from the container sidewall inner surface with the bag suspended in the container interior and the bag interior filled with a food product.

2. The apparatus of claim 1, wherein:

the bag sidewall top edge resiliently engages in friction engagement with the outer surface of the container to suspend the bag bottom above the container bottom wall in the container interior, the bag bottom being suspended in the container interior above the container bottom wall solely by the friction engagement of the bag sidewall top edge with the outer surface of the container.

3. The apparatus of claim 1, wherein:

the bag sidewall top edge engages in sliding friction engagement with the outer surface of the container to suspend the bag bottom in an adjustable position above the container bottom wall in the container interior, enabling adjusting a suspended position of the bag bottom above the container bottom wall in a first direction away from the container bottom wall in response to sliding the bag sidewall top edge over the outer surface of the container in a second direction, opposite to the first direction.

4. The apparatus of claim 3, wherein:

the sliding friction engagement of the bag sidewall top edge with the outer surface of the container enables adjusting a suspended position of the bag bottom above the container bottom wall in the second direction toward the container bottom wall in response to sliding the bag sidewall top edge over the outer surface of the container in the first direction, opposite to the second direction.

5. The apparatus of claim 1, wherein:

the bag sidewall circumference is substantially constant for a length of the bag between the bag bottom and the top edge of the bag, and the bag sidewall is resiliently stretchable to enlarge the bag sidewall circumference at the top edge of the bag and stretch the bag sidewall top edge over the container top edge and around the container outer surface.

6. The apparatus of claim 5, wherein:

the bag sidewall is resiliently stretchable along the length of the bag enabling the bag circumference to be enlarged along the length of the bag and stretched over the container top edge and around the container outer surface.

7. The apparatus of claim 1, wherein:

a cover member is releasably connectable to the top edge of the container over the container opening to enclose the interior of the container.

8. An apparatus for storing and preserving food products and for selectively dispensing the food products from the apparatus, the apparatus comprising:

a container having a horizontal bottom wall and at least one vertical sidewall connected to and extending vertically upward from the bottom wall, the sidewall having an inner surface and an outer surface, the inner surface surrounding an interior of the container, and the sidewall having a top edge surrounding an opening at a top of the container, the opening providing access down into the container interior;

a bag inserted vertically downward into the container interior, the bag having a bottom and at least one stretchable sidewall connected to and extending vertically upward from the bag bottom, the bag sidewall having an inner surface and an outer surface, the bag sidewall inner surface surrounding an interior of the bag, and the bag sidewall having a top edge surrounding an opening at the top of the bag, the bag opening providing access down into the interior of the bag;

the container sidewall inner surface having a horizontal circumference of a first measure and the bag sidewall outer surface having a horizontal circumference of a second measure, the second measure being less than the first measure thereby enabling the bag sidewall outer surface to be spaced from the container sidewall inner surface with the bag inserted down into the container interior and the bag interior filled with a food product; and the bag top edge and a first portion of the bag sidewall being stretched and folded vertically downward over the top edge of the container sidewall and a portion of the outer surface of the container sidewall, the first portion of the bag sidewall engaging in friction contact with the portion of the container sidewall outer surface and thereby suspending the bag bottom and a second portion of the bag sidewall in the container interior spaced above the container bottom wall with the outer surface of the second portion of the bag sidewall being spaced from the inner surface of the container sidewall.

9. The apparatus of claim 8, wherein:

the first portion of the bag sidewall engages in sliding friction engagement with the portion of the container outer surface to suspend the bag bottom in a vertically adjustable position above the container bottom wall in the container interior, enabling adjusting a suspended position of the bag bottom above the container bottom wall in an upward vertical direction away from the container bottom wall in response to sliding the first portion of the bag sidewall in a downward vertical direction over the outer surface of the container.

10. The apparatus of claim 9, wherein:

the sliding friction engagement of the first portion of the bag sidewall with the outer surface of the container enables adjusting a suspended position of the bag bottom above the container bottom wall in a downward vertical direction toward the container bottom wall in response to sliding the first portion of the bag sidewall in an upward vertical direction over the outer surface of the container.

11. The apparatus of claim 8, wherein:

the bag sidewall horizontal circumference is substantially constant for a vertical length of the bag between the bag bottom and the bag top edge, and the bag sidewall is resiliently stretchable to enlarge the bag sidewall circumference at the top edge and first sidewall portion of the bag and stretch the bag top edge and first sidewall portion over the container top edge and around the container outer surface.

12. The apparatus of claim 11, wherein:

the bag sidewall is resiliently stretchable along the vertical length of the bag enabling the bag horizontal circumference to be enlarged along the vertical length of the bag and stretched over the container top edge and around the container outer surface.

13. The apparatus of claim 8, wherein:

a cover member is releasably connectable to the top edge of the container over the container opening to enclose the interior of the container.

14. The apparatus of claim 8, wherein:

the bag bottom is suspended in the container interior above the container bottom wall solely by the friction contact between the first portion of the bag sidewall and the portion of the container sidewall outer surface.

15. An apparatus for storing and preserving food products and for selectively dispensing the food products from the apparatus, the apparatus comprising:

a container having a bottom wall and four sidewalls connected with the bottom wall and extending in an upward, substantially perpendicular direction for a first length from the bottom wall, the bottom wall and four sidewalls being arranged in a rectangular configuration and the bottom wall and four sidewalls each having an inner surface surrounding an interior of the container, the four sidewalls each having a top edge opposite the connection of the sidewalls to the bottom wall, the sidewall top edges extending around an opening of the container that provides access to the container interior, the container sidewall inner surfaces having a circumference of a first measure that is substantially constant for the first length of the container between the bottom wall and the top edge of the container sidewalls;

a flexible and resilient bag having a bottom and at least one sidewall connected with the bag bottom and extending in an upward direction for a second length from the bag bottom, the second length being greater than the first length, the bag bottom and sidewall each having an inner surface surrounding an interior of the bag and the bag sidewall having a top edge opposite the connection of the bag sidewall to the bag bottom, the bag top edge extending around an opening of the bag that provides access to the interior of the bag;

the bag sidewall having a first, unstretched circumference of a second measure that the bag sidewall assumes with the bag containing a food product, the unstretched circumference is substantially constant for the second length of the bag between the bag bottom and the bag sidewall top edge, the second measure being less than the first measure thereby enabling the bag sidewall to be spaced from the container sidewall inner surface with the bag containing a food product inserted down into the container interior, and the bag sidewall having a second, stretched circumference of a third measure that a first portion of the bag sidewall assumes with the bag sidewall top edge and the first portion of the bag sidewall being stretched and folded back over the container sidewall top edges and around an outer surface of the container sidewalls to engage in friction contact over the container sidewalls and to suspend the bag bottom in the container interior with the bag bottom spaced above the container bottom wall.

16. The apparatus of claim 15, wherein:

a second portion of the bag sidewall suspended in the container interior is spaced from the inner surface of the container sidewalls.

17. The apparatus of claim 15, wherein:

the bag sidewall top edge and the first portion of the bag sidewall engage in sliding friction contact over the outer surface of the container to suspend the bag bottom in an adjustable position above the container bottom in the container interior, the position of the bag bottom being adjusted in an upward direction in the container interior away from the container bottom wall in response to the first portion of the bag sidewall in friction engagement over the outer surface of the container sidewalls being slid in a downward direction over the outer surface of the container sidewalls, and the position of the bag bottom being adjusted in a downward direction in the container interior toward the container bottom wall in response to the first portion of the bag sidewall in friction engagement over the outer surface of the container sidewalls being slid in an upward direction over the outer surface of the container sidewalls.

18. The apparatus of claim 15, wherein:

the bag bottom is suspended in the container interior above the container bottom wall solely by the friction engagement of the first portion of the bag sidewall over the container sidewall top edges and around the outer surface of the container sidewalls.

19. The apparatus of claim 15, wherein:

a cover member is releasably connectable to the top edges of the container sidewalls and over the container opening to enclose the interior of the container.

* * * * *